US009399240B2

(12) United States Patent
Hung et al.

(10) Patent No.: US 9,399,240 B2
(45) Date of Patent: Jul. 26, 2016

(54) WATERPROOF COATING PROCESS MACHINE AND ITS NEGATIVE PRESSURE COATING AND ATOMIZED COATING METHODS

(71) Applicants: San-Ming Hung, Taichung (TW); Hao-I Tsai, Taichung (TW)

(72) Inventors: San-Ming Hung, Taichung (TW); Hao-I Tsai, Taichung (TW)

(73) Assignee: Hung M & S Biochem Technology Co. Ltd., Taichung (TW)

( * ) Notice: Subject to any disclaimer, the term of this patent is extended or adjusted under 35 U.S.C. 154(b) by 99 days.

(21) Appl. No.: 14/318,664

(22) Filed: Jun. 29, 2014

(65) Prior Publication Data

US 2015/0375264 A1 Dec. 31, 2015

(30) Foreign Application Priority Data

Jun. 28, 2013 (TW) ..... 102212293 U
Dec. 12, 2013 (TW) ..... 102145788 A

(51) Int. Cl.

| | |
|---|---|
| ***B05C 5/02*** | (2006.01) |
| ***B05D 5/00*** | (2006.01) |
| ***B05D 1/02*** | (2006.01) |
| ***B05D 1/18*** | (2006.01) |
| ***B05D 3/00*** | (2006.01) |
| ***B05D 3/06*** | (2006.01) |
| ***B05D 3/04*** | (2006.01) |
| ***B05D 7/22*** | (2006.01) |
| *B05D 3/02* | (2006.01) |

(52) U.S. Cl.

CPC ... *B05D 1/18* (2013.01); *B05C 5/02* (2013.01); *B05D 3/0493* (2013.01); *B05D 7/22* (2013.01); *B05D 3/0263* (2013.01)

(58) Field of Classification Search

None

See application file for complete search history.

(56) References Cited

U.S. PATENT DOCUMENTS

| | | | | | |
|---|---|---|---|---|---|
| 1,410,465 | A * | 3/1922 | Gamm | D21H 23/68 | 118/202 |
| 1,953,569 | A * | 4/1934 | Sagit | E04D 15/00 | 156/461 |
| 2,056,387 | A * | 10/1936 | Canon | C04B 20/0076 | 106/482 |
| 2,484,797 | A * | 10/1949 | Agamaite, Jr. | A47K 10/424 | 221/46 |
| 3,603,099 | A * | 9/1971 | Zakiewicz | E02D 5/187 | 37/355 |
| 2007/0186813 | A1* | 8/2007 | Smith | B05B 7/0846 | 106/281.1 |
| 2009/0047438 | A1* | 2/2009 | Kawata | E04D 15/07 | 427/426 |
| 2013/0330467 | A1* | 12/2013 | Bond | E21D 11/10 | 427/8 |

* cited by examiner

*Primary Examiner* — Dah-Wei D Yuan
*Assistant Examiner* — Jethro M Pence
(74) *Attorney, Agent, or Firm* — Che-Yang Chen; Law Offices of Scott Warmuth

(57) ABSTRACT

A waterproof coating process machine and its negative pressure coating and atomized coating methods are disclosed. The machine includes a coating process tank disposed at a top end, a drying chamber and a control panel. A discharge port connected with a discharge pipe on an outer side is disposed at a bottom of the coating process tank; and at least one negative pressure suction port connected with a suction pipe of a suction pump is disposed on a back side. An opening of the drying chamber in combination with a movable door is disposed at a front side of a lower section of the machine. An infrared outlet, an infrared spiral wave outlet and a circulation fan are disposed inside the drying chamber. The control panel is disposed on the front side of the machine between the coating process tank and the drying chamber.

11 Claims, 11 Drawing Sheets

WATERPROOF COATING PROCESS MACHINE AND ITS NEGATIVE PRESSURE COATING AND ATOMIZED COATING METHODS

BACKGROUND OF THE INVENTION

1. Field of Invention

The present invention relates to a waterproof coating process machine and its negative pressure coating and atomized coating methods and more particularly to a waterproof coating process machine for processing negative pressure coating and atomized coating with a liquid waterproof coating agent as well as subsequent drying and hardening for various types of work-pieces.

2. Related Art

Coating is widely applied in various high value electronic products and components. For instance, the popular mobile phone requires to be processed with waterproof coating or anti-scratch coating for preventing internal parts from malfunctioning caused by damp or from being scratched.

The above coating is commonly formed as a layer of spread coating structure or a layer of spray coating structure on a work-piece surface by spreading or spraying a liquid waterproof coating agent on the work-piece surface for achieving waterproof or anti-scratching effect for the surface.

However, the above layer of spread coating structure or layer of spray coating structure formed on the work piece surface with the liquid waterproof coating agent has a drawback that the coating structure cannot be thoroughly adhered on dead angles or pores during processing to form a thorough coating for achieving an all-round protection.

Furthermore, take mobile phone as an example. The mobile phone case has to be disassembled first before the internal parts can be processed against damp. Therefore, another drawback is that it is troublesome in processing and work period will be prolonged.

A last drawback is that, warranty clause for mobile phone and other electronic products usually prescribes that the product case must not be disassembled, or else the warranty will be voided if the case has been disassembled for processing the internal parts.

SUMMARY OF THE INVENTION

The present invention of a waterproof coating process machine and its negative pressure coating and atomized coating methods aim to solve the drawbacks of the conventional waterproof coating structure, which are unable to provide thorough adhering and protection, troublesome process of disassembling the product case, and the risk of losing product warranty.

A primary objective of the present invention is to provide a waterproof coating process machine and its negative pressure coating and atomized coating methods for processing waterproof coating and atomized coating with a waterproof coating agent as well as subsequent drying for various types of work-pieces in order that the waterproof coating agent can be permeated into all pores of the work piece to form a fill-in, sealed type adhered waterproof coating structure for achieving a thorough protection both internally and externally.

A secondary objective of the present invention is to provide a waterproof coating process machine and its negative pressure coating and atomized coating methods for processing waterproof coating without the need of disassembling a product case for effectively enhancing the convenience and speed in processing.

A third objective of the present invention is to provide a waterproof coating process machine and its negative pressure coating and atomized coating methods without the need of disassembling a product case in order to avoid the risk of losing warranty.

A waterproof coating process machine is provided by the present invention. The machine comprising a coating process tank, the tank being a space with an upwardly facing opening disposed at a top end of the machine, the upwardly facing opening having an airtight cover for covering the opening tightly, a discharge port connected with a discharge pipe on an outer side of the coating process tank being disposed at a bottom of the coating process tank for forming a discharging structure for discharging internal liquids, at least one negative pressure suction port being disposed on a back side of the coating process tank, a guide and suction pipe being disposed at an outer end of each of the negative pressure suction ports, the guide and suction pipes being connected with a suction pipe of a suction pump inside the machine; a drying chamber, the chamber being a space with a front opening disposed at a lower section of the machine, the front opening being disposed with a movable door, an infrared outlet and an infrared spiral wave outlet being disposed on an upper wall of an internal space of the drying chamber, a circulation fan being disposed on a side wall for facilitating internal thermal convection; and a control panel disposed on a front side of the machine between the coating process tank and the drying chamber, a power switch for providing power for the machine including the suction pump, a pressure control switch for controlling an internal working pressure of the coating process tank, a time delay switch for controlling the suction of the suction pump, a temperature-control power supply for providing power for the drying chamber and a temperature-control switch for monitoring temperature being disposed on the control panel.

A negative pressure coating method of the present invention comprising following procedures of:

a pre-operational process: the power switch of the control panel being turned on, a liquid waterproof coating agent being poured into the coating process tank (not passing the height of the negative pressure suction ports), a properly cleaned work piece being immersed in the waterproof coating agent;

a negative pressure coating process: the suction pump being turned on for sucking the negative pressure suction ports through the guide and suction pipes connected with the suction pipe, the pressure control switch controlling an intensity of a suction pressure for forming a negative pressure environment in the coating process tank, a difference of external and internal pressures being formed above and under a liquid surface of the waterproof coating agent by the negative pressure environment for expelling all the air in all pores in the work piece outside the liquid surface of the waterproof coating agent and enabling the waterproof coating agent to permeate into all the pores of the work piece in order to thoroughly form a fill-in, sealed type adhered waterproof coating structure;

a process for finished product: checking through the airtight cover of the negative pressured coating process tank that no air bubbles being formed on the liquid surface of the waterproof coating agent to indicate that all the pores on the work piece being permeated and filled in by the waterproof coating agent for forming the fill-in, sealed type adhered waterproof coating structure, the negative pressured suction being stopped and the airtight cover being opened for taking out the work piece as a processed product; and a drying and hardening process: the work piece processed with the waterproof coating agent being placed inside the drying chamber, the temperature-control power supply on the control panel being turned on after the moveable door being closed for emitting infrared rays by the infrared outlet for drying the work piece surface, and for emitting infrared spiral waves by the infrared spiral wave outlet for drying an interior of the work piece, the circulation fan being used for facilitating internal thermal convection in order that the waterproof coating structure inside and on the work piece being dried and hardened.

Another waterproof coating process machine is provided according to a second embodiment of the present invention. The machine comprising a coating process tank, the tank being a space with an upwardly facing opening disposed at a top end of the machine, the upwardly facing opening having an airtight cover for covering the opening tightly, a discharge port connected with a discharge pipe on an outer side of the coating process tank being disposed at a bottom of the coating process tank for forming a discharging structure for discharging internal liquids, at least one negative pressure suction port being disposed on a back side of the coating process tank, a guide and suction pipe being disposed at an outer end of each of the negative pressure suction ports, the guide and suction pipes being connected with a suction pipe of a suction pump inside the machine, a cyclical output pipe connected with an output hole at the bottom of the coating process tank being disposed on the suction pump; a drying chamber, the chamber being a space with a front opening disposed at a lower section of the machine, the front opening being disposed with a movable door, an infrared outlet and an infrared spiral wave outlet being disposed on an upper wall of an internal space of the drying chamber, a circulation fan being disposed on a side wall for facilitating internal thermal convection; a control panel disposed on a front side of the machine between the coating process tank and the drying chamber, a power switch for providing power for the machine including the suction pump, a pressure control switch for controlling an internal working pressure of the coating process tank, a time delay switch for controlling the suction of the suction pump, a temperature-control power supply for providing power for the drying chamber and a temperature-control switch for monitoring temperature being disposed on the control panel; an atomizer with an inlet disposed at a bottom for connecting with an inner end of the output hole at the bottom of the coating process tank coupled with the cyclical output pipe, an outlet being disposed on a side of the atomizer for spraying a liquid waterproof coating agent as a spray; and an atomized coating process case comprising a first case body, a second case body and a partition plate, the first case body and the second case body being shell cases made of a transparent material, inner edges being disposed on inner sides of opposite opening ends of the first case body and the second case body, a first coating chamber and a second coating chamber being formed inside the first case body and the second case body respectively, clamping grooves being formed on outer openings of the inner edges of the first case body and the second case body, a connection port being formed on other ends of the first case body and the second case body respectively, the partition plate being a plate made of a flexible material for being clamped in and between the two clamping grooves of the first case body and the second case body for separating the first coating chamber and the second coating chamber, an airtight enclosing hole being disposed at a center of the partition plate for encasing different work pieces tightly, the connection port of the second case body being connected with the negative pressure suction port, and the connection port of the first case body being connected with the outlet of the atomizer for composing a positive-negative pressured cyclical structure inside the machine.

The atomized coating method of the present invention comprising following procedures of:

a pre-operational process: a properly cleaned work piece being tightly encased in the airtight enclosing hole of the partition plate, the partition plate being sleeved and assembled in the two oppositely disposed clamping grooves of the first case body and the second case body for being pressed and clamped tightly by the two inner edges in order to separate the first coating chamber and the second coating chamber, the work piece being installed between the separated first coating chamber and the second coating chamber of the atomized coating process case;

an atomized process for a waterproof coating agent: the waterproof coating agent pre-filled in the atomizer being formed as a spray by the operation of the atomizer, the spray being outputted to the first coating chamber of the first case body of the atomized coating process case through the outlet of the atomizer;

an intermittent suction process with a difference between positive and negative pressures: when the suction pump being turned on for processing an intermittent negative pressure suction, the pressure control switch controlling an intensity of the suction pressure, the second coating chamber being sucked through the suction pipe to form a negative pressured space in order to form a difference between positive and negative pressures between the first coating chamber and the second coating chamber, the effect of the pressure differences enabling the waterproof coating agent spray in the first coating chamber to enter inside an interior of the work piece from an exposed hole (e.g. a hole for speakers, receiving sound or charging) at an end of the work piece and to enter into the second coating chamber through another hole at another end of the work piece after passing gaps between components in the interior space, the waterproof coating agent spray being flowed towards the suction pump through the suction pipe, then being flowed towards the atomizer for recycling through the cyclical output pipe, and being sprayed into the first coating chamber again for achieving a positive-negative pressured convectional cycle;

a permeating and adhering process of the waterproof coating agent: the positive-negative pressured convectional cycle enabling the waterproof coating agent spray permeated through the exposed hole of the work piece to adhere thoroughly on all the pore surfaces of the components of the work piece when the waterproof coating agent spray passing through the internal space of the work piece in order to thoroughly form a fill-in, sealed type adhered waterproof coating structure on all the component surfaces;

a process for finished product: after the work piece being processed with the waterproof coating agent spray for achieving the thorough adhering process, the suction of the suction pump being stopped, the atomized coating process case being opened and the work piece being taken out as a processed product; and a drying and hardening process: the work piece processed with the waterproof coating agent being placed inside the drying chamber, the temperature-control power supply on the control panel being turned on after the moveable door being closed for emitting infrared rays by the infrared outlet for drying the work piece surface, and for emitting infrared spiral waves by the infrared spiral wave outlet for drying the interior of the work piece, the circulation fan being used for facilitating internal thermal convection in order that the waterproof coating structure inside and on the work piece being dried and hardened.

As mentioned above, a sensor is disposed on an inner side of the opening of the coating process tank for sensing opening and closing of the airtight cover. The sensor is connected to the suction pump for turning on or turning off the suction pump based on opening and closing signals of the airtight cover sensed by the sensor.

As mentioned above, both the discharge pipe and the suction pipe have a connector with a switch handle. One of the guide and suction pipes of the negative pressure suction ports has a connector with a switch handle provided for switching to have the single guide and suction pipe or all of the guide and suction pipes connected with the suction pipe.

As mentioned above, a special control switch, a molecular rearrangement switch and an emergency switch are further disposed on the control panel.

As mentioned above, the airtight cover, the first case body and the second case body of the atomized coating process case are made of a transparent material.

As mentioned above, the work piece is a smart phone, a tablet computer, an automobile navigational system, a handheld game console, an electronic dictionary, a video player or a MP3 player.

The present invention will become more fully understood by reference to the following detailed description thereof when read in conjunction with the attached drawings.

DETAILED DESCRIPTION OF THE INVENTION

Figure 1:
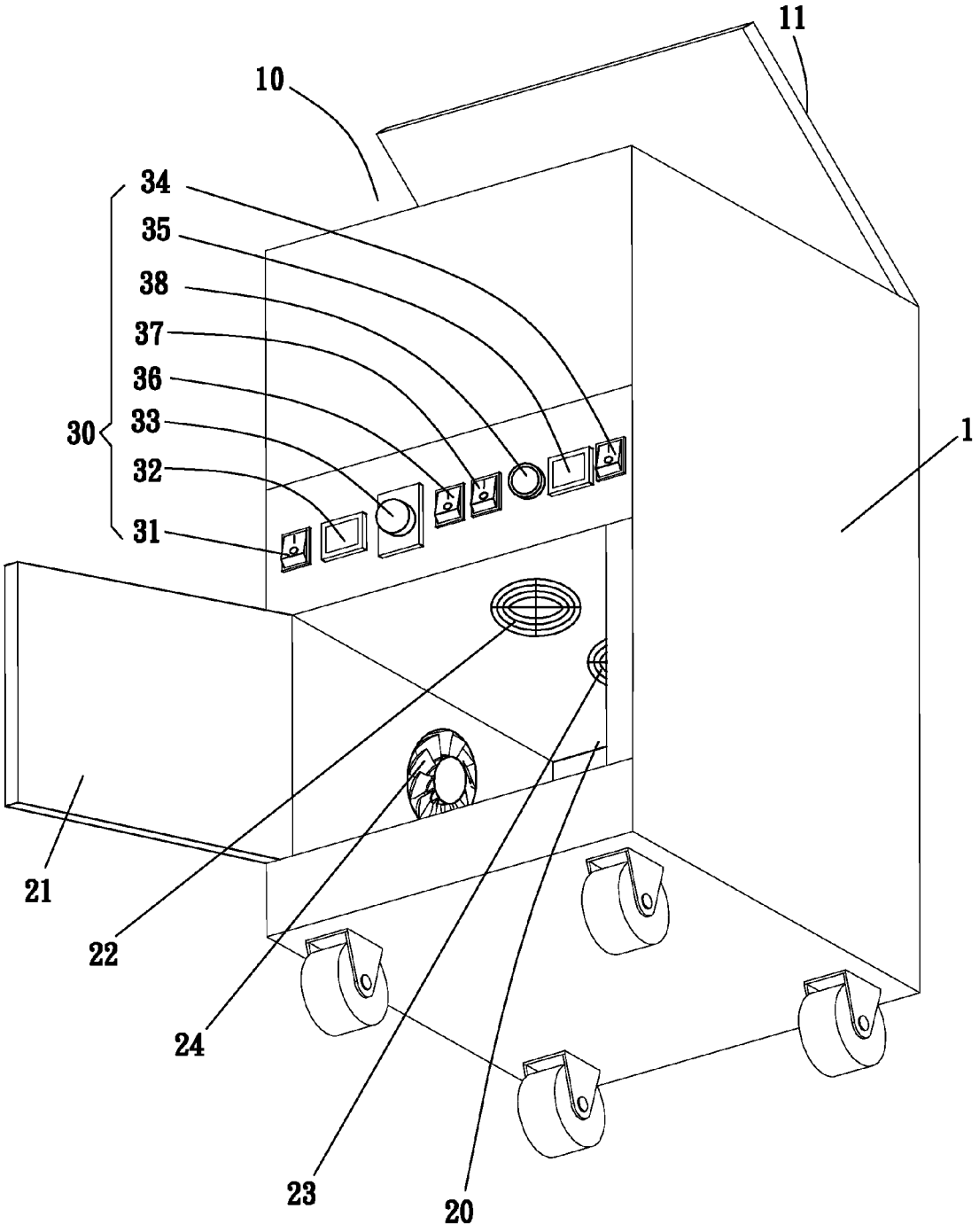
FIG. 1 is a front perspective view of a waterproof coating process machine of the present invention.
Figure 2:
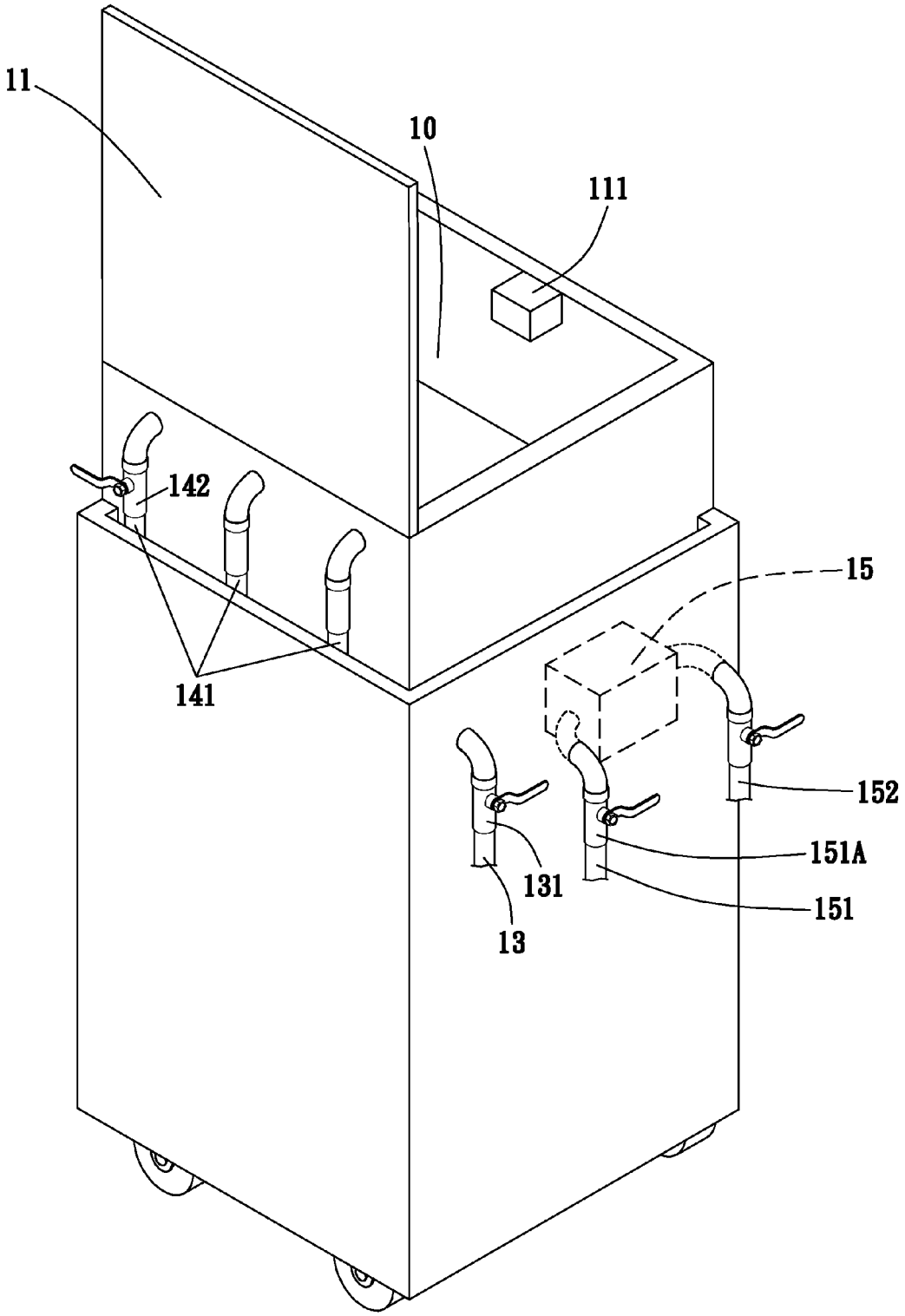
FIG. 2 is a rear perspective view of the waterproof coating process machine of the present invention.
Figure 3:
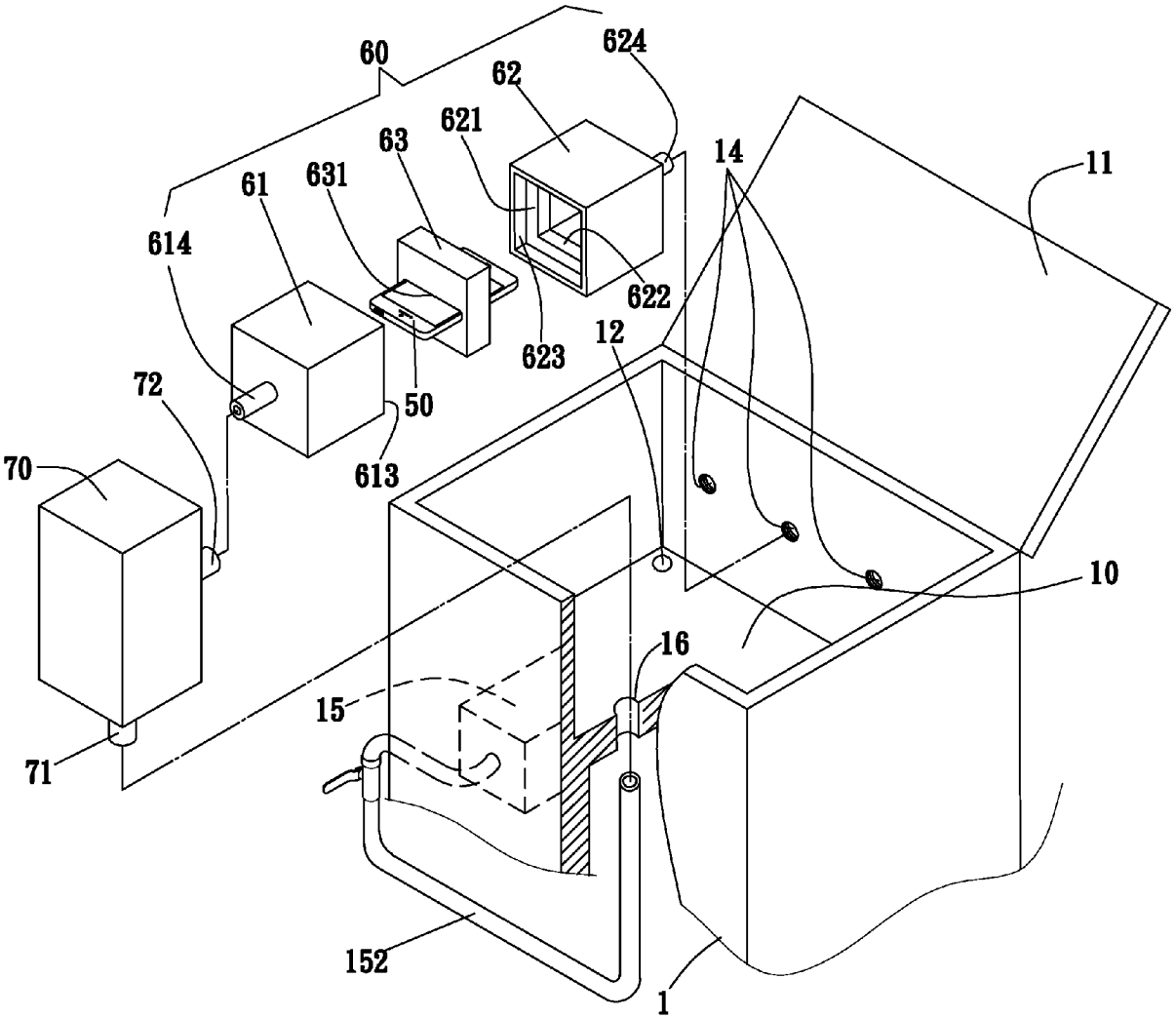
FIG. 3 is a perspective exploded view of a coating process tank and an atomized coating process case of the present invention.

A preferred embodiment of the present invention is provided for processing a negative pressure coating process and an atomized coating process for a work piece 50 with a liquid waterproof coating agent 40. Please refer to FIGS. 1, 2 and 3. FIG. 1 is a front perspective view of a waterproof coating process machine of the present invention; FIG. 2 is a rear perspective view of the waterproof coating process machine of the present invention; and FIG. 3 is a perspective exploded view of a coating process tank and an atomized coating process case of the present invention. A waterproof coating process machine 1 of the present invention comprises a coating process tank 10, a drying chamber 20, a control panel 30, an atomized coating process case 60 (shown in FIG. 3) for encasing the work piece 50 (e.g. cloth; shoe; IC components; communication, consumer electronics, computer products; the work piece is a mobile phone in this embodiment), and an atomizer 70 (shown in FIG. 3).

Please refer to FIGS. 2 and 3. The coating process tank 10 is a space with an upwardly facing opening disposed at a top end of the waterproof coating process machine 1. The upwardly facing opening has an airtight cover 11 made of a transparent material. A sensor 111 is disposed on an inner side of the opening of the coating process tank 10 for sensing opening and closing of the airtight cover 11. A discharge port 12 connected with a discharge pipe 13 on an outer side of the coating process tank 10 is disposed at a bottom of the coating process tank 10 for forming a discharging structure for discharging internal liquids. The discharge pipe 13 has a connector 131 with a switch handle. At least one negative pressure suction port 14 is disposed on a back side of the coating process tank 10, and a guide and suction pipe 141 is coupled at an outer end of each of the negative pressure suction ports 14. The guide and suction pipes 141 are connected with a suction pipe 151 of a suction pump 15 (indicated by dotted lines in FIGS. 2 and 3) inside the waterproof coating process machine 1. One of the guide and suction pipes 141 has a connector 142 with a switch handle provided for switching to have the single guide and suction pipe 141 or all of the guide and suction pipes 141 connected with the suction pipe 151. The suction pump 15 (indicated by the dotted lines in FIGS. 2 and 3) is disposed inside the waterproof coating process machine 1, and connected to the sensor 111 for being turned on or turned off based on opening and closing signals of the airtight cover 11 sensed by the sensor 111. A cyclical output pipe 152 connected with an output hole 16 at the bottom of the coating process tank 10 is disposed on the suction pump 15. The suction pipe 151 has a connector 151A with a switch handle.

The drying chamber 20 is a space with a front opening disposed at a lower section of the waterproof coating process machine 1. The front opening is disposed with a movable door 21. An infrared outlet 22 and an infrared spiral wave outlet 23 are disposed on an upper wall of an internal space of the drying chamber 20. A circulation fan 24 is disposed on a side wall for facilitating internal thermal convection.

The control panel 30 is disposed on a front side of the waterproof coating process machine 1 between the coating process tank 10 and the drying chamber 20. A power switch 31 for providing power for the waterproof coating process machine 1 including the suction pump 15, a pressure control switch 32 for controlling an internal working pressure of the coating process tank 10, a time delay switch 33 for controlling the suction of the suction pump 15, a temperature-control power supply 34 for providing power for the drying chamber 20, a temperature-control switch 35 for monitoring temperature, a special control switch 36, a molecular rearrangement switch 37 and an emergency switch 38 are disposed on the control panel 30.

Figure 4:
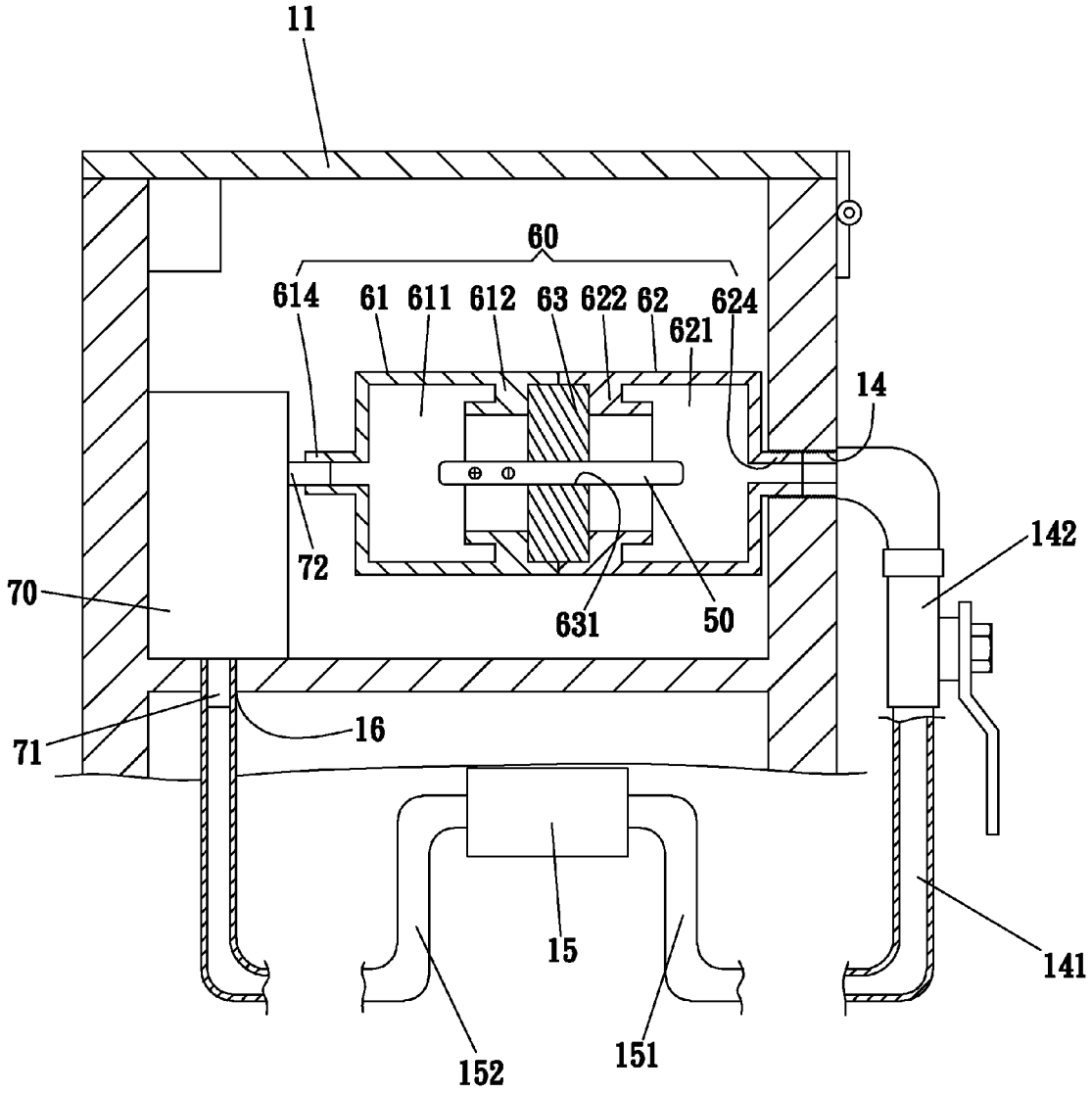
FIG. 4 is a sectional view of the assembled coating process tank and the atomized coating process case of the present invention.

As shown in FIGS. 3 and 4, the atomized coating process case 60 comprises a first case body 61, a second case body 62 and a partition plate 63. The first case body 61 and the second case body 62 are shell cases made of a transparent material. Inner edges 612 and 622 are disposed on inner sides of opposite opening ends of the first case body 61 and the second case body 62 for forming a first coating chamber 611 and a second coating chamber 621 inside the first case body 61 and the second case body 62 respectively. Clamping grooves 613 and 623 are formed on outer openings of the inner edges 612 and 622 of the first case body 61 and the second case body 62. Connection ports 614 and 624 are formed on other ends of the first case body 61 and the second case body 62 respectively. The partition plate 63 is a plate made of a flexible material for being clamped in and between the two clamping grooves 613 and 623 of the first case body 61 and the second case body 62 for separating the first coating chamber 611 and the second coating chamber 621. An airtight enclosing hole 631 is disposed at a center of the partition plate 63 for tightly encasing the work piece 50 with different shapes.

As shown in FIG. 3, the atomizer 70 with an inlet 71 disposed at a bottom is for connecting with the cyclical output pipe 152 at the output hole 16 at the bottom of the coating process tank 10. An outlet 72 is disposed on a side of the atomizer 70 for spraying the liquid waterproof coating agent 40 as a spray.

Please refer to FIG. 4; FIG. 4 is a sectional view of the assembled coating process tank and the atomized coating process case of the present invention. Based on the above structural combinations of the waterproof coating process machine 1, the connection port 624 of the second case body 62 of the atomized coating process case 60 is connected with the suction pipe 151 of the suction pump 15 through the negative pressure suction port 14. The connection port 614 of the first case body 61 is connected with the outlet 72 of the atomizer 70, and the inlet 71 of the atomizer 70 is connected with the cyclical output pipe 152 of the suction pump 15 for enabling the work piece 50 to be processed with negative pressure coating inside the coating process tank 10, or to be processed with atomized coating inside the atomized coating process case 60. Then, the drying process can be processed in the drying chamber 20 (as shown in FIG. 1).

Figure 5:
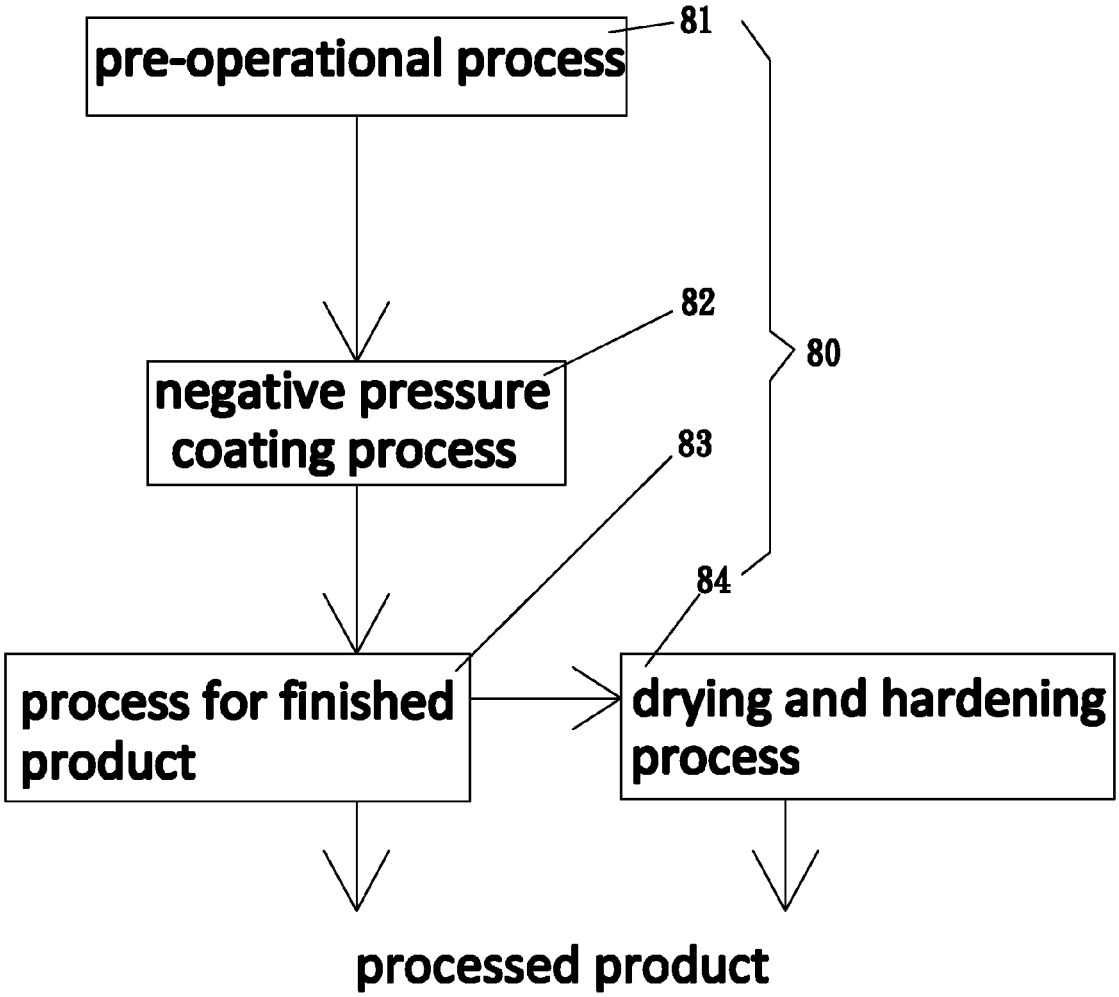
FIG. 5 is a flow chart of a negative pressure coating method of the present invention.
Figure 6:
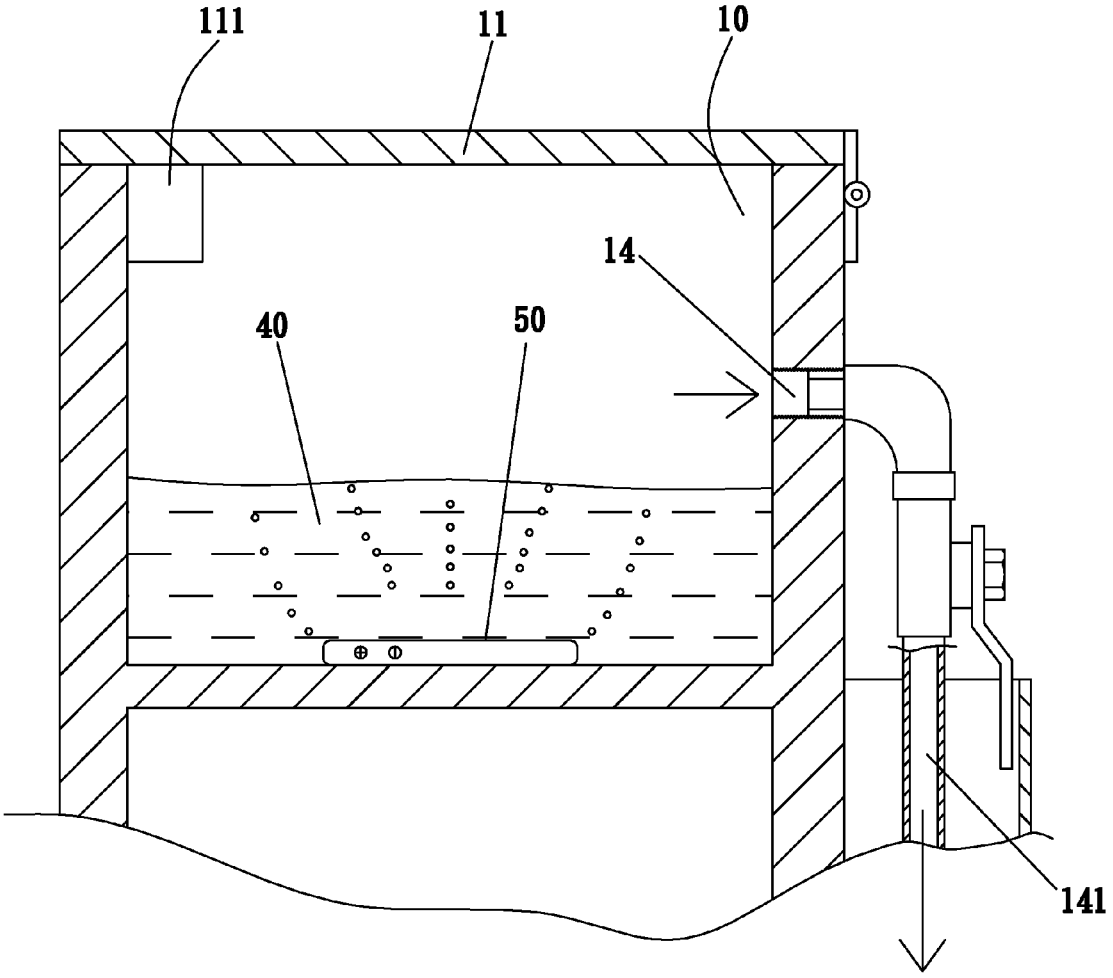
FIG. 6 is a schematic view of processing a negative pressure coating of the present invention.
Figure 7:
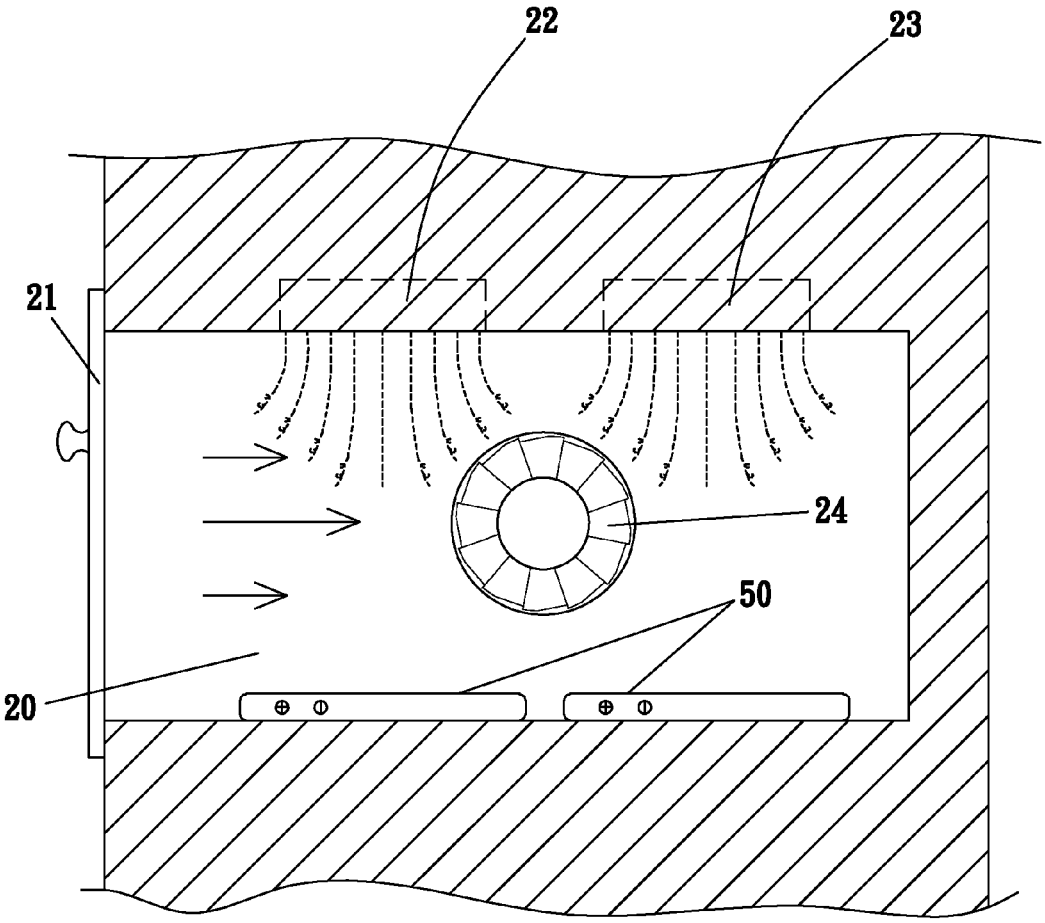
FIG. 7 is a schematic view of processing a drying and hardening process of the present invention.

Please refer to FIG. 5; FIG. 5 is a flow chart of a negative pressure coating method of the present invention. A negative pressure coating method 80 of the present invention comprising following procedures of:

a pre-operational process 81: the power switch 31 of the control panel 30 being turned on (as shown in FIG. 1), the liquid waterproof coating agent 40 being poured into the coating process tank 10 (not passing the height of the negative pressure suction ports 14), the properly cleaned work piece 50 being immersed in the waterproof coating agent 40 (as shown in FIG. 6);

a negative pressure coating process 82: as shown in FIG. 6, the airtight cover 11 being closed for pressing and contacting the sensor 111 in order to control the suction pump 15 (as shown in FIGS. 2, 3 and 4) to suck the negative pressure suction ports 14 through the guide and suction pipes 141 connected with the suction pipe 151, the pressure control switch 32 (as shown in FIG. 1) controlling an intensity of a suction pressure for forming a negative pressure environment in the coating process tank 10, a difference of external and internal pressures being formed above and under a liquid surface of the waterproof coating agent 40 by the negative pressure environment for expelling all the air in all pores in the work piece 50 (mobile phone) outside the liquid surface of the waterproof coating agent 40 and enabling the waterproof coating agent 40 to permeate into all the pores of the work piece 50 in order to thoroughly form a fill-in, sealed type adhered waterproof coating structure;

a process for finished product 83: checking through the airtight cover 11 of the negative pressured coating process tank 10 that no air bubbles being formed on the liquid surface of the waterproof coating agent 40 to indicate that all the pores on the work piece 40 being permeated and filled in by the waterproof coating agent 40 for forming the fill-in, sealed type adhered waterproof coating structure, the negative pressured suction being stopped and the airtight cover 11 being opened for taking out the work piece 50 (mobile phone) as a processed product; and a drying and hardening process 84: as shown in FIG. 7, the work piece 50 (mobile phone) processed with the waterproof coating agent 40 being placed inside the drying chamber 20, the temperature-control power supply 34 (as shown in FIG. 1) on the control panel 30 being turned on after the moveable door 21 being closed for emitting infrared rays by the infrared outlet 22 for drying the work piece 50 (mobile phone) surface, and for emitting infrared spiral waves by the infrared spiral wave outlet 23 for drying an interior of the work piece 50 (mobile phone), the circulation fan 24 being used for facilitating internal thermal convection in order that the waterproof coating structure inside and on the work piece 50 (mobile phone) being dried and hardened.

Figure 8:
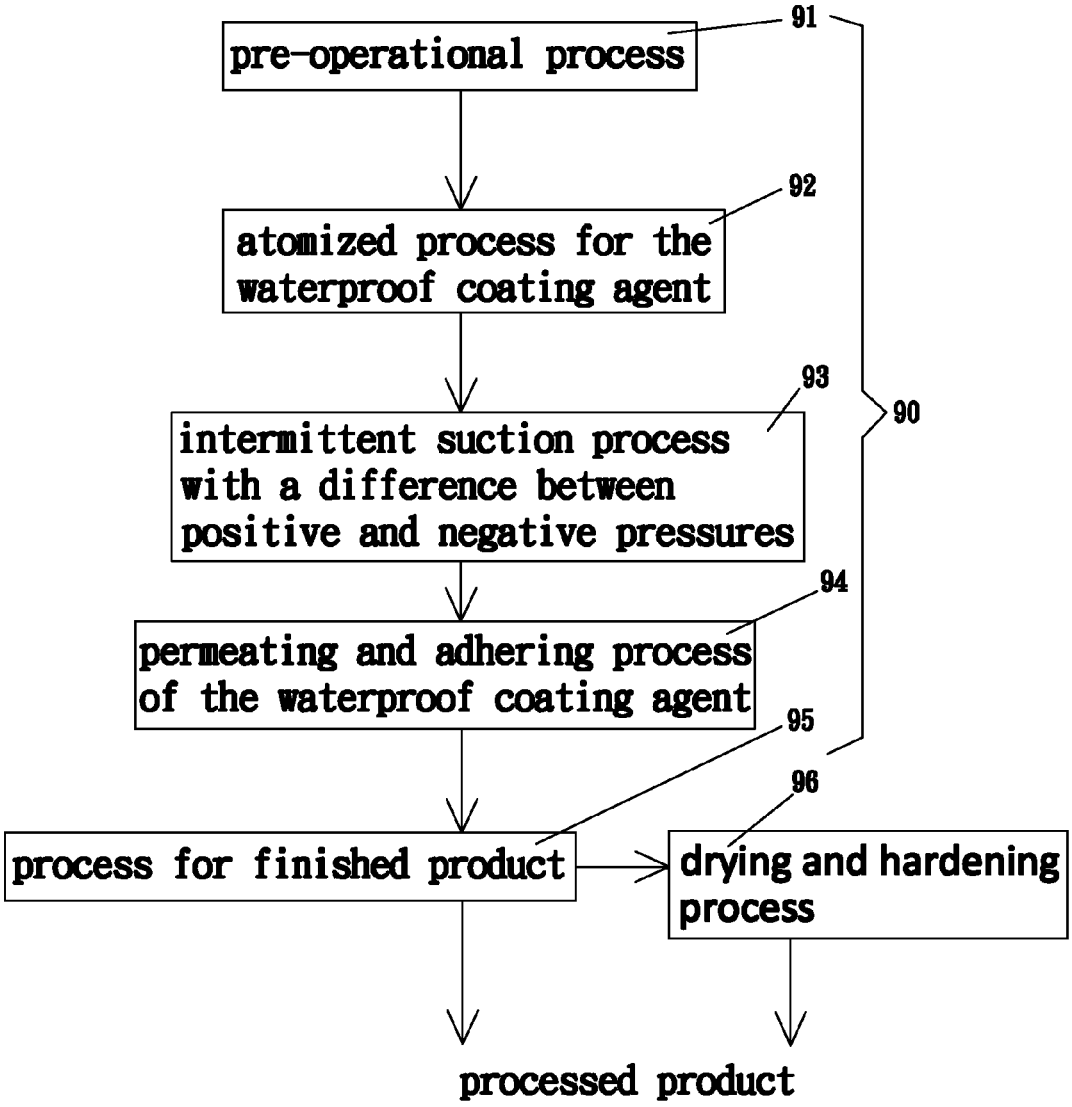
FIG. 8 is a flow chart of an atomized coating method of the present invention.
Figure 9:
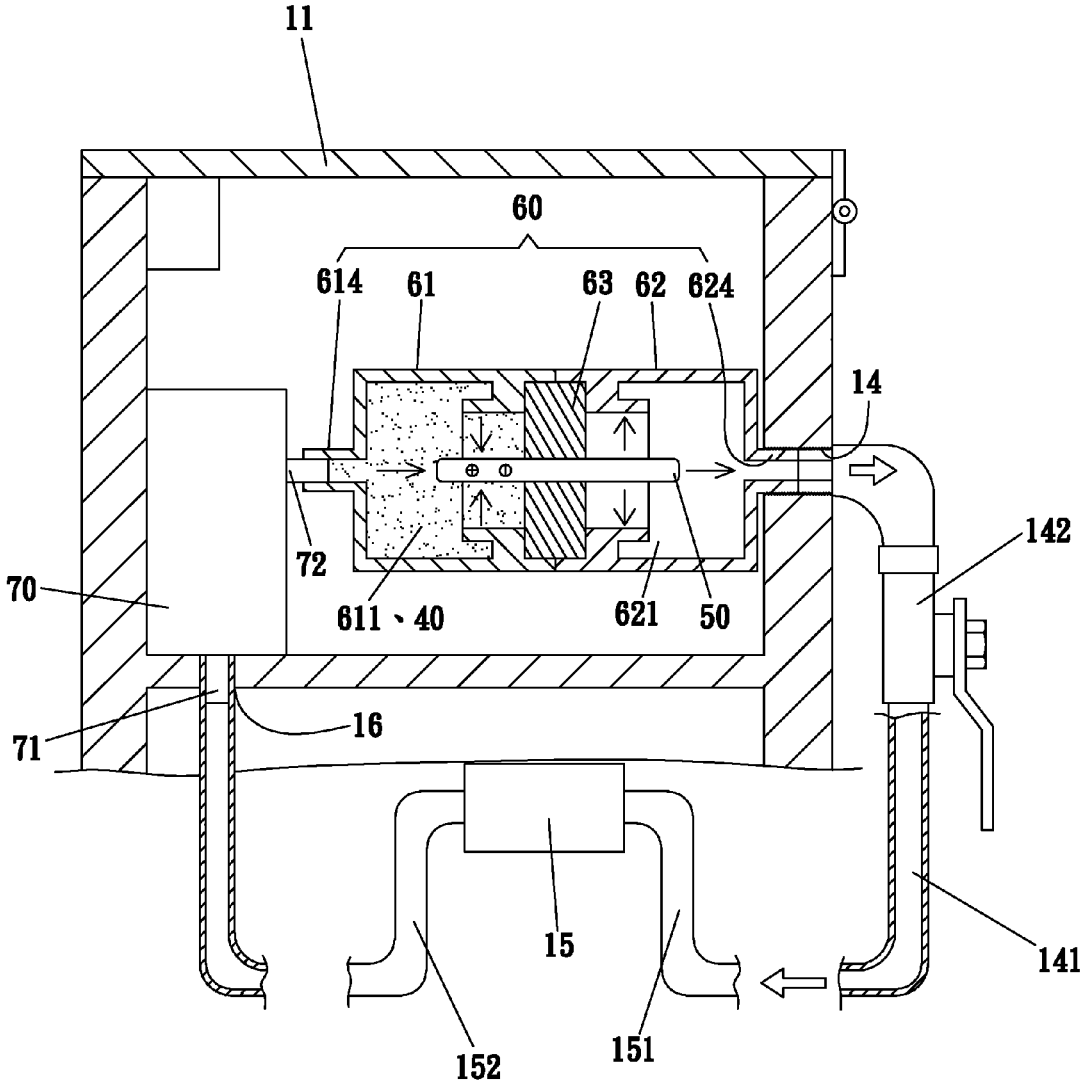
FIG. 9 is a sectional schematic view of an atomized process for a waterproof coating agent of the present invention.
Figure 10:
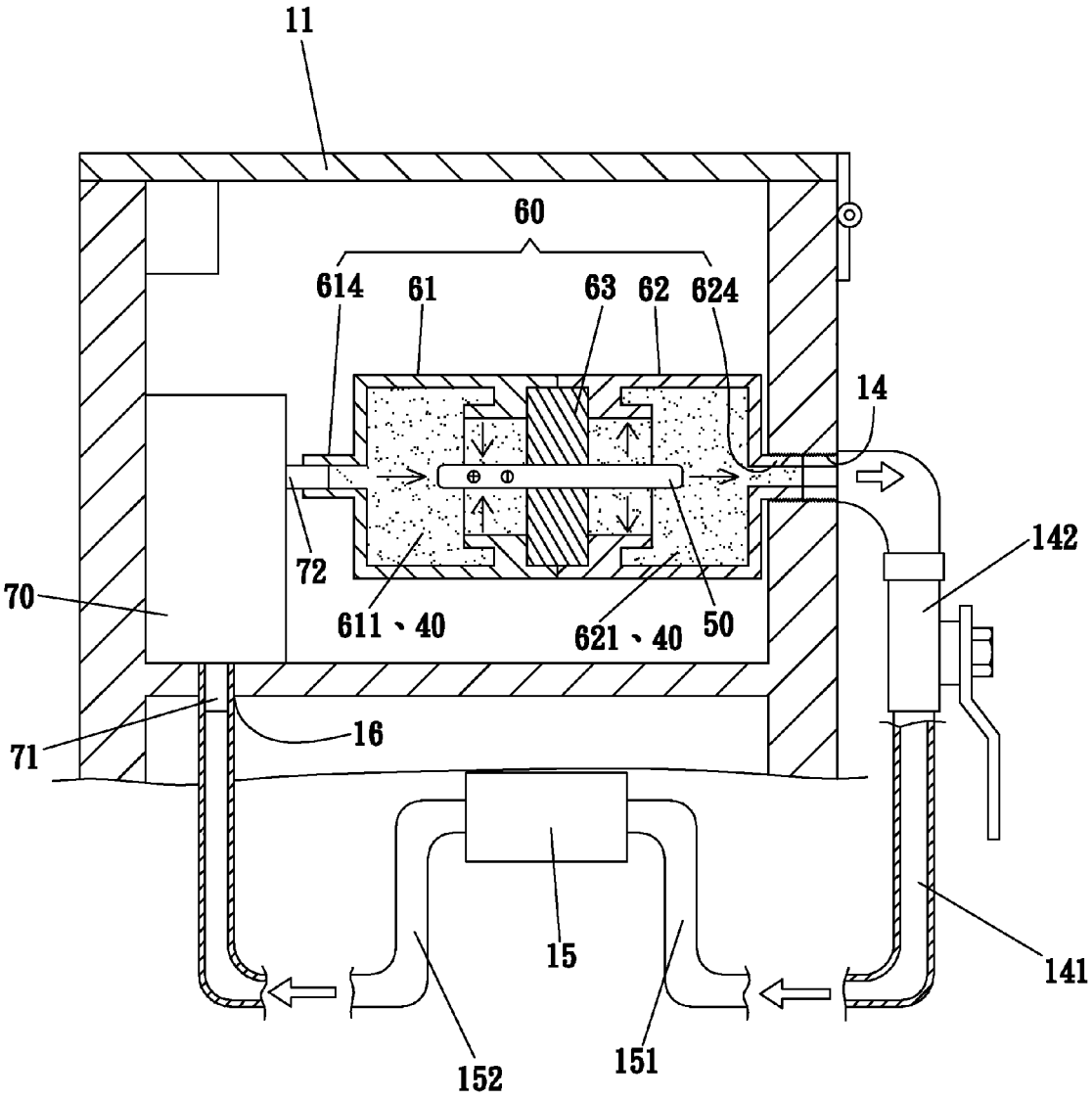
FIG. 10 is a sectional schematic view of an intermittent suction process with a difference between positive and negative pressures of the present invention.

Please refer to FIG. 8; FIG. 8 is a flow chart of an atomized coating method 90 of the present invention. An atomized coating method 90 of the present invention comprising following procedures of:

a pre-operational process 91: as shown in FIGS. 3 and 4, the properly cleaned work piece 50 being tightly encased in the airtight enclosing hole 631 of the partition plate 63 of the atomized coating process case 60, the partition plate 63 being sleeved and assembled in the two oppositely disposed clamping grooves 613 and 623 of the first case body 61 and the second case body 62 for being pressed and clamped tightly by the two inner edges 612 and 622 in order to separate the first coating chamber 611 and the second coating chamber 621, the work piece 50 being installed between the separated first coating chamber 611 and the second coating chamber 621 of the atomized coating process case 60;

an atomized process for the waterproof coating agent 92: as shown in FIG. 9, the waterproof coating agent 40 pre-filled in the atomizer 70 being formed as a spray by the operation of the atomizer 70, the spray being outputted to the first coating chamber 611 of the first case body 61 of the atomized coating process case 60 through the outlet 72 of the atomizer 70;

an intermittent suction process with a difference between positive and negative pressures 93: as indicated by hollow arrows in FIGS. 9 and 10, the airtight cover 11 being closed for pressing and contacting the sensor 111 in order to control the suction pump 15 to process an intermittent negative pressure suction, the pressure control switch 32 controlling an intensity of the suction pressure, the second coating chamber 621 being sucked through the suction pipe 15 to form a negative pressured space in order to form a difference between positive and negative pressures between the separated first coating chamber 611 and the second coating chamber 621, the effect of the pressure differences enabling the waterproof coating agent spray 40 in the first coating chamber 611 to enter the interior of the work piece 50 from an exposed hole (e.g. a hole for speakers, receiving sound or charging) at an end of the work piece 50 as indicated by solid arrows in the figures, and to enter into the second coating chamber 621 through another hole at another end of the work piece 50 after passing gaps between components in the interior space as shown in FIG. 10, the waterproof coating agent spray 40 being flowed towards the suction pump 15 through the suction pipe 151, then being flowed towards the atomizer 70 for recycling through the cyclical output pipe 152, and being sprayed into the first coating chamber 611 again for achieving a positive-negative pressured convectional cycle;

a permeating and adhering process of the waterproof coating agent 94: the positive-negative pressured convectional cycle enabling the waterproof coating agent spray 40 permeated through the exposed hole of the work piece 50 to adhere thoroughly on all the pore surfaces of the components of the work piece 50 when the waterproof coating agent spray 40 passing through the internal space of the work piece 50 in order to thoroughly form a fill-in, sealed type adhered waterproof coating structure on all the component surfaces;

a process for finished product 95: after the work piece 50 being processed with the waterproof coating agent spray 40 for achieving the thorough adhering process, the suction pump 15 being turned off for stopping the suction, the atomized coating process case 60 being opened and the work piece 50 being taken out as a processed product; and a drying and hardening process 96: as shown in FIG. 7, the work piece 50 (mobile phone) processed with the waterproof coating agent 40 being placed inside the drying chamber 20, the temperature-control power supply 34 (as shown in FIG. 1) on the control panel 30 being turned on after the moveable door 21 being closed for emitting infrared rays by the infrared outlet 22 for drying the work piece 50 surface, and for emitting infrared spiral waves by the infrared spiral wave outlet 23 for drying the interior of the work piece 50 (mobile phone), the circulation fan 24 being used for facilitating internal thermal convection in order that the waterproof coating structure inside and on the work piece 50 (mobile phone) being dried and hardened.

Figure 11:
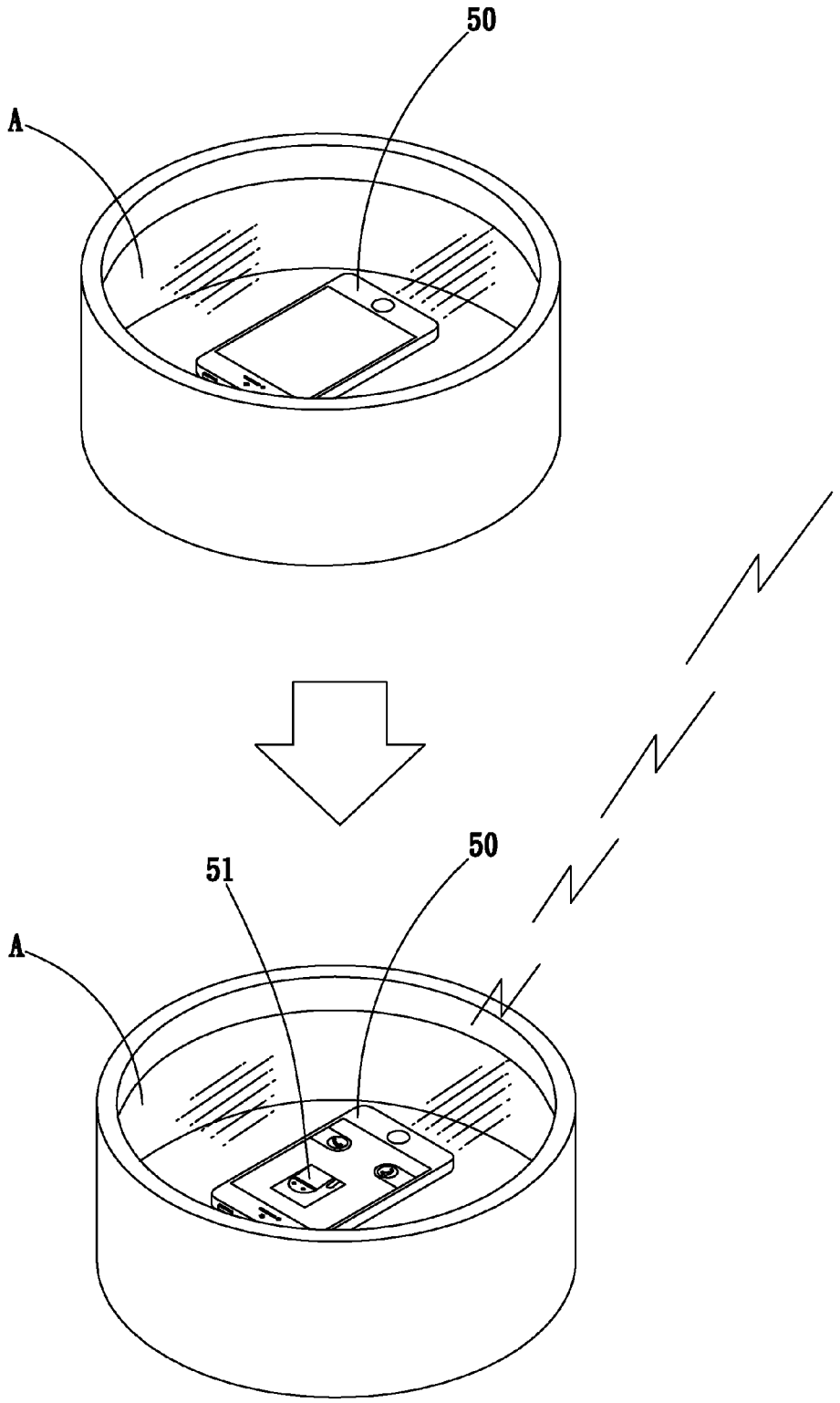
FIG. 11 is a schematic view of processing a waterproof test for a work piece of the present invention.

Please refer to FIG. 11; FIG. 11 is a schematic view of processing a waterproof test for the waterproof coated work piece of the present invention. As shown in the upper figure, the work piece 50 (mobile phone) processed with the waterproof coating is immersed into a container of water A, and the work piece 50 (mobile phone) is proved to be waterproof by the waterproof coating structure formed and adhered by the processing. As shown in the lower figure, when the number of the work piece 50 (mobile phone) is dialed, the work piece 50 (mobile phone) immersed in the water can still receive the phone signal and a call screen 51 is turned on.

The waterproof coating process machine and its negative pressure coating and atomized coating methods of the present invention can be used for processing the negative pressure coating and the atomized coating with the waterproof coating agent as well as the subsequent drying for various types of work-pieces in order that the waterproof coating agent can be permeated into all the pores of the work piece to thoroughly form the fill-in, sealed type adhered waterproof coating structure for effectively enhancing the convenience and speed in coating and avoiding the risk of losing warranty of the work piece.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A waterproof coating process machine structure, the machine comprising:

a coating process tank, the tank being a space with an upwardly facing opening disposed at a top end of the machine, the upwardly facing opening having an airtight cover for covering the opening tightly, a discharge port connected with a discharge pipe on an outer side of the coating process tank being disposed at a bottom of the coating process tank for forming a discharging structure for discharging internal liquids, at least one negative pressure suction port being disposed on a back side of the coating process tank, a guide and suction pipe being disposed at an outer end of each of the negative pressure suction ports, the guide and suction pipes being connected with a suction pipe of a suction pump inside the machine;

a drying chamber, the chamber being a space with a front opening disposed at a lower section of the machine, the front opening being disposed with a movable door, an infrared outlet and an infrared spiral wave outlet being disposed on an upper wall of an internal space of the drying chamber, a circulation fan being disposed on a side wall for facilitating internal thermal convection; and a control panel disposed on a front side of the machine between the coating process tank and the drying chamber, a power switch for providing power for the machine including the suction pump, a pressure control switch for controlling an internal working pressure of the coating process tank, a time delay switch for controlling the suction of the suction pump, a temperature-control power supply for providing power for the drying chamber and a temperature-control switch for monitoring temperature being disposed on the control panel.

2. A waterproof coating process machine structure, the machine comprising:

a coating process tank, the tank being a space with an upwardly facing opening disposed at a top end of the machine, the upwardly facing opening having an airtight cover for covering the opening tightly, a discharge port connected with a discharge pipe on an outer side of the coating process tank being disposed at a bottom of the coating process tank for forming a discharging structure for discharging internal liquids, at least one negative pressure suction port being disposed on a back side of the coating process tank, a guide and suction pipe being disposed at an outer end of each of the negative pressure suction ports, the guide and suction pipes being connected with a suction pipe of a suction pump inside the machine, a cyclical output pipe connected with an output hole at the bottom of the coating process tank being disposed on the suction pump;

a drying chamber, the chamber being a space with a front opening disposed at a lower section of the machine, the front opening being disposed with a movable door, an infrared outlet and an infrared spiral wave outlet being disposed on an upper wall of an internal space of the drying chamber, a circulation fan being disposed on a side wall for facilitating internal thermal convection;

a control panel disposed on a front side of the machine between the coating process tank and the drying chamber, a power switch for providing power for the machine including the suction pump, a pressure control switch for controlling an internal working pressure of the coating process tank, a time delay switch for controlling the suction of the suction pump, a temperature-control power supply for providing power for the drying chamber and a temperature-control switch for monitoring temperature being disposed on the control panel;

an atomizer with an inlet disposed at a bottom for connecting with an inner end of the output hole at the bottom of the coating process tank coupled with the cyclical output pipe, an outlet being disposed on a side of the atomizer for spraying a liquid waterproof coating agent as a spray; and an atomized coating process case comprising a first case body, a second case body and a partition plate, the first case body and the second case body being shell cases made of a transparent material, inner edges being disposed on inner sides of opposite opening ends of the first case body and the second case body, a first coating chamber and a second coating chamber being formed inside the first case body and the second case body respectively, clamping grooves being formed on outer openings of the inner edges of the first case body and the second case body, a connection port being formed on other ends of the first case body and the second case body respectively, the partition plate being a plate made of a flexible material for being clamped in and between the two clamping grooves of the first case body and the second case body for separating the first coating chamber and the second coating chamber, an airtight enclosing hole being disposed at a center of the partition plate for encasing different work pieces tightly.

3. The waterproof coating process machine structure as claimed in claim 1, wherein a sensor is disposed on an inner side of the opening of the coating process tank for sensing opening and closing of the airtight cover, the sensor is connected to the suction pump for turning on or turning off the suction pump based on opening and closing signals of the airtight cover sensed by the sensor.

4. The waterproof coating process machine structure as claimed in claim 1, wherein both the discharge pipe and the suction pipe have a connector with a switch handle, one of the guide and suction pipes of the negative pressure suction ports has a connector with a switch handle provided for switching to have the single guide and suction pipe or all of the guide and suction pipes connected with the suction pipe.

5. The waterproof coating process machine structure as claimed in claim 1, wherein a special control switch, a molecular rearrangement switch and an emergency switch are further disposed on the control panel.

6. The waterproof coating process machine structure as claimed in claim 1, wherein the airtight cover as well as the first case body and the second case body of the atomized coating process case are made of a transparent material.

7. The waterproof coating process machine structure as claimed in claim 1, wherein the work piece is a smart phone, a tablet computer, an automobile navigational system, a handheld game console, an electronic dictionary, a video player or a MP3 player.

8. The waterproof coating process machine structure as claimed in claim 2, wherein a sensor is disposed on an inner side of the opening of the coating process tank for sensing opening and closing of the airtight cover, the sensor is connected to the suction pump for turning on or turning off the suction pump based on opening and closing signals of the airtight cover sensed by the sensor.

9. The waterproof coating process machine structure as claimed in claim 2, wherein both the discharge pipe and the suction pipe have a connector with a switch handle, one of the guide and suction pipes of the negative pressure suction ports has a connector with a switch handle provided for switching to have the single guide and suction pipe or all of the guide and suction pipes connected with the suction pipe.

10. The waterproof coating process machine structure as claimed in claim 2, wherein a special control switch, a molecular rearrangement switch and an emergency switch are further disposed on the control panel.

11. The waterproof coating process machine structure as claimed in claim 2, wherein the airtight cover as well as the first case body and the second case body of the atomized coating process case are made of a transparent material.

* * * * *